US005483323A

United States Patent [19]

Matsuda et al.

[11] Patent Number: 5,483,323

[45] Date of Patent: Jan. 9, 1996

[54] ELECTROPHOTOGRAPHIC APPARATUS UTILIZING A HOLLOW ROLLER CHANGING MECHANISM

[75] Inventors: Masanori Matsuda; Eiji Gotoh; Akinori Nishida, all of Osaka, Japan

[73] Assignee: Mita Industrial Co., Ltd., Osaka, Japan

[21] Appl. No.: 251,314

[22] Filed: May 31, 1994

[30] Foreign Application Priority Data

May 31, 1993 [JP] Japan ..... 5-129271
Jun. 30, 1993 [JP] Japan ..... 5-162204

[51] Int. Cl.[6] ..... G03G 15/02

[52] U.S. Cl. ..... 355/219; 355/296

[58] Field of Search ..... 355/219, 296; 361/212, 220–222, 225

[56] References Cited

U.S. PATENT DOCUMENTS

| | | | |
|---|---|---|---|
| 4,392,177 | 7/1983 | Geyken | 361/221 |
| 5,088,706 | 4/1991 | Ohmori et al. | 355/219 |
| 5,095,335 | 3/1992 | Watanabe et al. | 355/219 X |
| 5,126,913 | 6/1992 | Araya et al. | 361/225 |
| 5,144,368 | 9/1992 | Ohzeki et al. | 355/219 |
| 5,146,280 | 9/1992 | Kisu | 361/225 X |
| 5,321,471 | 6/1994 | Ito et al. | 355/219 |
| 5,357,323 | 10/1994 | Haneda et al. | 355/219 |
| 5,367,364 | 11/1994 | Michlin et al. | 355/219 |
| 5,367,365 | 11/1994 | Haneda et al. | 355/219 |
| 5,410,386 | 4/1995 | Swift et al. | 355/219 X |
| 5,426,488 | 6/1995 | Hayakawa et al. | 355/219 |

*Primary Examiner*—A. T. Grimley
*Assistant Examiner*—Shuk Y. Lee
*Attorney, Agent, or Firm*—Sherman and Shalloway

[57] ABSTRACT

In an electrophotographic apparatus using a charging apparatus for contact charging, the charging apparatus includes a flexible and hollow electrically conducting roller, and an electrically conducting brush roller which is provided in the hollow roller in concentric therewith and to rotate relative thereto, wherein a charging voltage is applied to the hollow roller via the brush roller, and the photosensitive material is electrically charged by rotating the hollow roller by bringing it into physical contact with the photosensitive material, and the hollow roller is brought at its both end portions into press-contact with the end portions on the surface of the photosensitive material and is rotated by being driven by the photosensitive material. In this apparatus, the hollow roller that comes into contact with the surface of the photosensitive material is driven at substantially the same speed as the photosensitive material, whereby slipping and wear are effectively prevented from occurring on the surface of the photosensitive material, durability of the photosensitive material is not lost, the hollow roller that is subject to be easily deformed is effectively prevented from being twisted, enabling the electric charging to be carried out stably and uniformly For extended periods of time.

4 Claims, 5 Drawing Sheets

ELECTROPHOTOGRAPHIC APPARATUS UTILIZING A HOLLOW ROLLER CHANGING MECHANISM

BACKGROUND OF THE INVENTION

1. Field of the Invention

The present invention relates to an electrophotographic apparatus using a charging apparatus for mainly charging the surface of a photosensitive material by contact charging.

2. Description of the Prior Art

In an image-forming method based upon the electrophotographic method, an image is formed by uniformly charging the surface of a photosensitive material, exposing the surface of the photosensitive material to the image-bearing light to form on the surface of the photosensitive material an electrostatic latent image that corresponds to the image of the document, and developing and transferring the electrostatic latent image.

In such an image-forming method, the surface of the photosensitive material is usually charged (mainly charged) by the corona charging accompanied, however, by the generation of ozone which contaminates the environment. In order to avoid the generation of ozone, a method has recently been proposed to mainly charge the surface of the photosensitive material by bringing an electrically conducting rubber roller into frictional contact with the surface of the photosensitive material while applying a bias voltage (Japanese Laid-Open Patent Publications Nos. 149669/1988 and 267667/1989).

According to the above-mentioned charging method based upon the frictional contact, however, the presence of foreign matters such as dust, paper powder, etc. between the electrically conducting rubber roller and the photosensitive material impairs the uniformity in the charging, and makes it difficult to stably carry out the charging. In forming the image, furthermore, when the surface of the photosensitive material is not so clean permitting the toner to stay thereon, then the residual toner may stick to the surface of the photosensitive material to deteriorate the durability of the photosensitive material. To carry out the uniform charging, furthermore, application of the DC bias voltage only is not sufficient and an AC bias voltage must be applied in combination.

In order to solve the above-mentioned problems, the present applicant has previously proposed a method of effecting the frictional charging by bringing a flexible and electrically conducting sheet into frictional contact with the surface of the photosensitive material by using a charging apparatus equipped with an electrically conducting brush roller while applying a DC voltage to the above roller (see Japanese Patent Application No. 68148/1992). The charging apparatus used for the above charging method usually comprises an electrically conducting brush roller and a flexible and hollow electrically conducting roller which contains the above brush roller and is so provided as to come into contact with the brush.

The above charging apparatus is very excellent in that the flexible and electrically conducting sheet constituting a hollow and electrically conducting roller is brought into intimate contact with the surface of the photosensitive material being pushed by the electrically conducting brush and, hence, frictional charging is uniformly carried out by simply applying a low DC bias voltage only to the electrically conducting brush without the need of applying an AC bias voltage.

However, the flexible and electrically conducting sheet that constitutes the hollow and electrically conducting roller rotates in contact with the surface of the photosensitive material being simply pushed by the Force of the brush. That is, the electrically conducting sheet rotates unstably giving rise to the occurrence of irregular rotation, slipping relative to the photosensitive material, and friction with respect to the surface of the photosensitive material. As a result, the photosensitive material is worn out and loses durability.

Furthermore, the electrically conducting sheet is usually very thin and may be twisted by the rotational driving force of the brush roller, resulting in the development of irregular charging. Moreover, the electrically conducting sheet may be broken as it is twisted constantly and more greatly.

According to the above charging apparatus in which the hollow and electrically conducting roller is press-contacted to the surface of the photosensitive material by the electrically conducting brush that is contained therein, hairs of the electrically conducting brush remain fallen down permanently when the copying operation is not carried out for extended periods of time. Consequently, the hollow and electrically conducting roller is deformed and makes it difficult to carry out the uniform charging. Moreover, foreign matters such as toner and dust adhered onto the surface of the photosensitive material migrate onto the surface of the hollow and electrically conducting roller and build up thereon. After used for extended periods of time, therefore, troubles develop such as irregular charging giving damage to the surface of the photosensitive material, which is a problem from the standpoint of life of the apparatus.

SUMMARY OF THE INVENTION

The object of the present invention therefore is to provide an electrophotographic apparatus using a charging apparatus which is capable of stably and uniformly charging the photosensitive material by the contact charging without causing the electrically conducting sheet press-contacted to the surface of the photosensitive material to be twisted and without causing the photosensitive material to lose its durability.

Another object of the present invention is to provide an electrophotographic apparatus which uses the charging apparatus of the above contact charging type as an apparatus for mainly charging the photosensitive material, wherein the surface of the photosensitive material is uniformly and stably charged for extended periods of time.

According to the present invention, there is provided an electrophotographic apparatus comprising a movable photosensitive material, a main charging apparatus, an image-exposing mechanism, a developing mechanism, a transfer mechanism and a cleaning member which are arranged in the order mentioned along the moving direction of the photosensitive material, wherein said main charging apparatus comprises a flexible, hollow and electrically conducting roller and an electrically conducting brush roller provided in said hollow roller in concentric therewith and to rotate relative to each other,e and the electric charging of the photosensitive material is carried out by rotating the hollow roller applied with a charging voltage via the brush roller and physically contacting the hollow roller to the photosensitive material, the improvement characterized in that the hollow roller is brought at its both end portions into press-contact with the end portions on the surface of the photosensitive material and is rotated being driven by the photosensitive material.

According to the charging apparatus used in the present invention, the flexible and hollow electrically conducting roller (hollow roller) is press-contacted at its both end portions to the end portions on the surface of the photosensitive material and, hence, rotates at substantially the same speed (peripheral speed) as the photosensitive material being driven thereby. Therefore, no slipping takes place between the photosensitive material and the hollow roller, and the photosensitive material is effectively prevented from being worn out and is further effectively liberated from the problem of losing durability. Moreover, the hollow roller is forcibly driven by the photosensitive material as it is press-contacted thereto; i.e., the hollow roller is effectively prevented from being twisted, and the electric charging is carried out stably and uniformly.

Both end portions of the hollow roller can be easily press-contacted by the charging apparatus in which the hollow roller is installed in a box having an opening and is placed near the opening, the box being allowed to turn with respect to the photosensitive material and the machine frame, and by urging the box toward the photosensitive material using a resilient member such as a leaf spring or the like. It is further allowable to provide both end portions of an endless, flexible and electrically conducting sheet constituting the hollow roller on the ring-like roller flange via an elastic member such as a rubber ring, and to press-contact both end portions by utilizing the elastic force thereof. In this case, the roller flange is provided on the shaft of the electrically conducting brush roller to rotate independently.

In the charging apparatus of the present invention, furthermore, the hollow roller contacting to the surface of the photosensitive material is flexible and is freely deformable, and is hence pushed by the electrically conducting brush roller. Therefore, even in case foreign matters such as dust, paper powder and residual toner are adhered on the surface of the photosensitive material, uniform contact is accomplished between the surface of the photosensitive material other than the portions where foreign matters are adhered and the hollow roller. Moreover, since the individual ears of the brush of the brush roller work as pushing springs, fine and intimate contact is accomplished between the surface of the photosensitive material and the hollow roller. That is, a uniform surface contact is accomplished between the two, making it possible to carry out uniform electric charging.

According to the present invention, furthermore, there is provided an electrophotographic apparatus using the above-mentioned charging apparatus as the main charging apparatus, wherein the hollow roller and the cleaning member of the main charging apparatus are adjustably provided so as to come into contact with the surface of the photosensitive material during the step of forming image and come out of contact with the surface of the photosensitive material after the completion of the step of forming image, the hollow roller is brought into contact with the surface of the photosensitive material after the cleaning member is brought into contact with the surface of the photosensitive material, and the hollow roller is separated away from the surface of the photosensitive material before the cleaning member is separated away from the surface of the photosensitive material.

According to the above electrophotographic apparatus, the hollow roller constituting the main charging apparatus is located being separated away from the surface of the photosensitive material. Therefore, no pressure is exerted from the surface of the photosensitive material upon the brush roller that is contained in the hollow roller, and the hairs of the brush are effectively prevented from falling down and the hollow roller is effectively prevented from deforming.

In a state in which the hollow roller is held in contact with the surface of the photosensitive material during the step of forming image, furthermore, the cleaning member is held in contact with the photosensitive material at all times. That is, the surface of the photosensitive material in which the hollow roller is in contact is always in a state of just after being cleaned. The present invention, therefore, makes it possible to effectively avoid such an inconvenience that foreign matter such as toner and dust migrate and build up on the hollow roller that mainly effects the electric charging. Accordingly, the electric charging can be carried out uniformly and stably without causing damage to the surface of the photosensitive material, and enabling good image to be obtained for extended periods of time.

DESCRIPTION OF THE INVENTION (Main Charging Apparatus)

Figure 1:
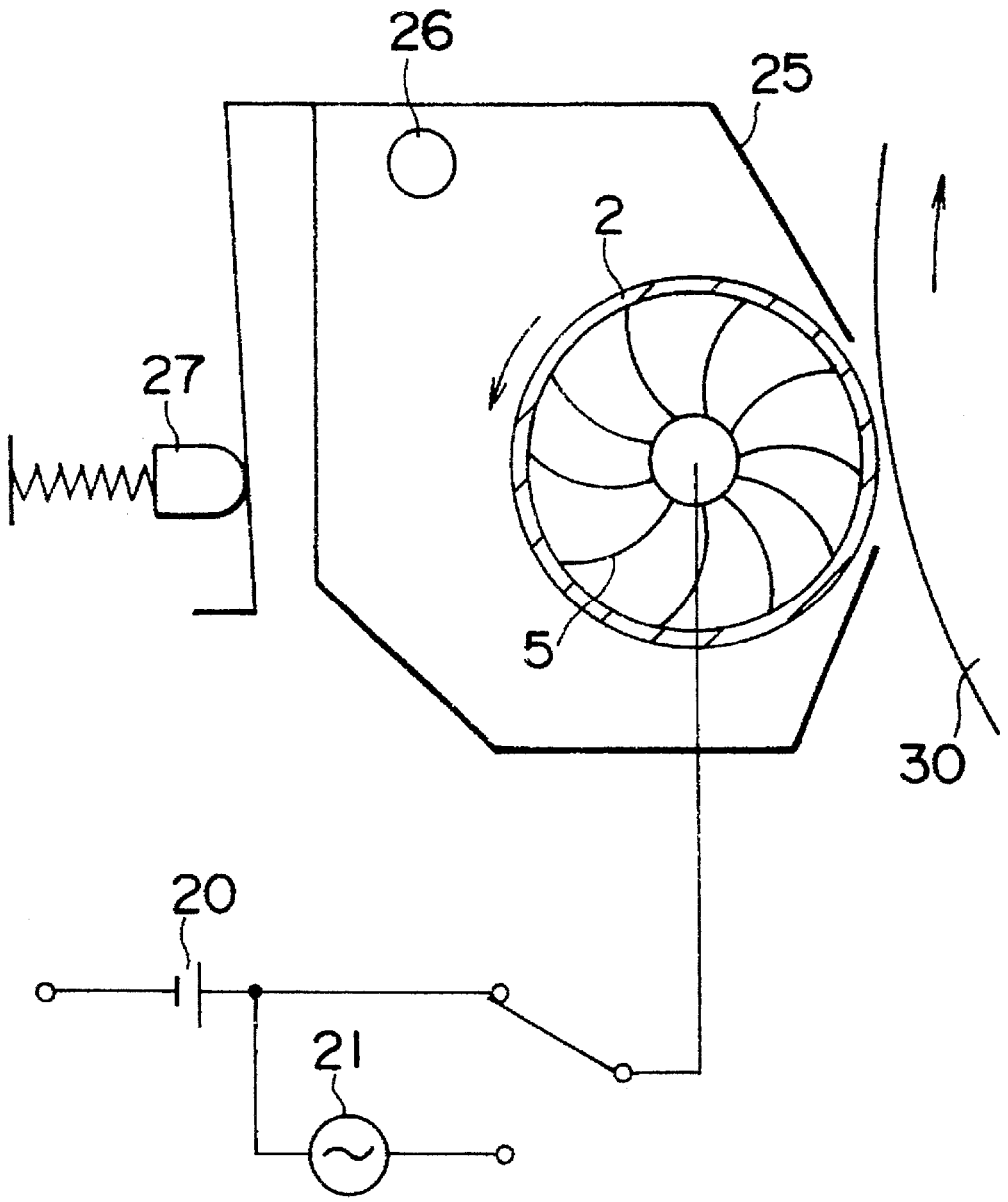
FIG. 1 is a side sectional view of a charging apparatus used as a main charging apparatus in the present invention together with a photosensitive drum.
Figure 2:
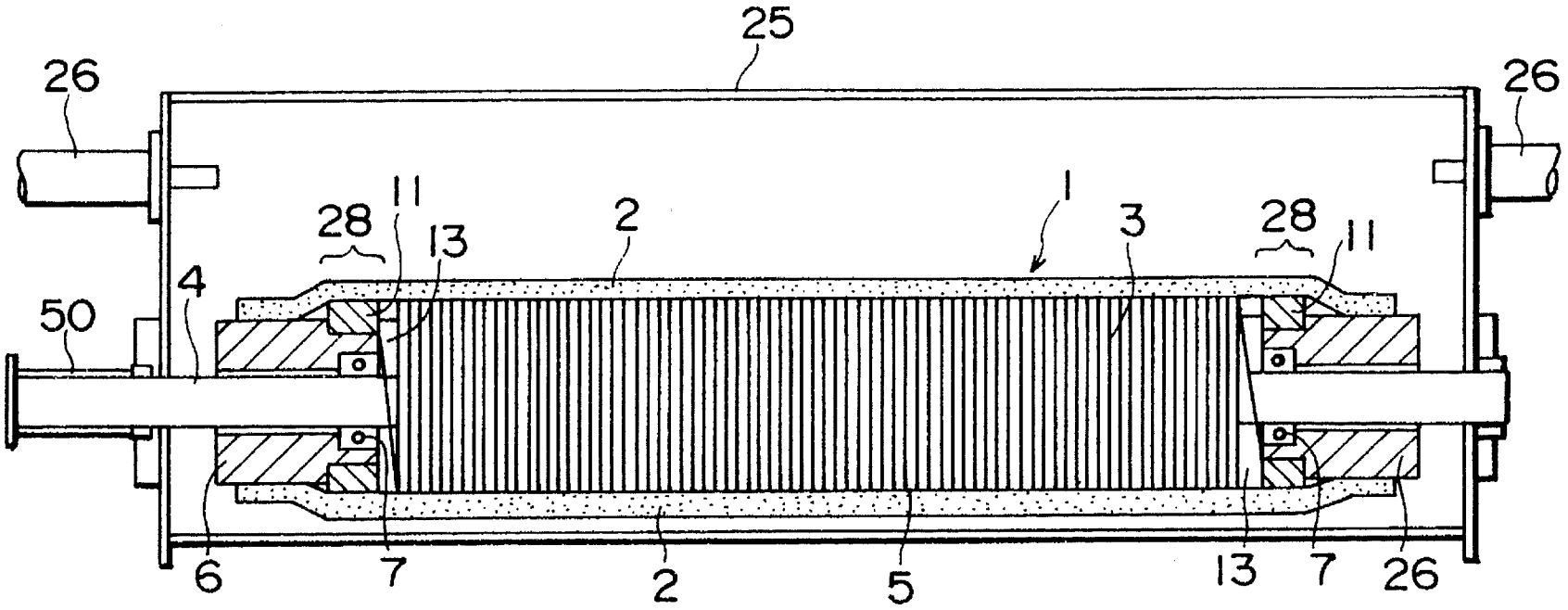
FIG. 2 is a front sectional view of the charging apparatus of FIG. 1.

Referring to FIGS. 1 and 2, the main charging apparatus roughly comprises a hollow and electrically conducting roller 1 made up of a flexible, endless and electrically conducting sheet 2 and rigid flange rings 6 provided at both end portions thereof, and an electrically conducting brush roller 3 provided in the flexible roller 1 in concentric therewith and to rotate relative to each other. The brush roller 3 is constituted by a drive shaft 4 and a brush 5 studded on the above shaft.

The inner surface of the flexible electrically conducting sheet 2 in the flexible roller 1 is in contact with the brush 5 of the electrically conducting brush roller 3 that is accommodated therein, and is supported by the brush 5.

Both end portions of the flexible sheet 2 are fastened to the flange rings 6 using an adhesive or the like. The flange rings 6 are fitted to the drive shaft by using a bearing 7 so as to rotate relative thereto. That is, both end portions of the sheet 2 are fastened to the flange rings 6 and can, hence, be press-contacted to the end portions of the photosensitive drum 30 very stably, so that the flexible roller 1 is driven without any difference in the peripheral speed from the surface of the drum. The drive shaft 4 of the brush roller 3 is coupled to a suitable drive member 20 such as a belt pulley, enabling the brush roller 3 to be driven independently of the flexible roller 1.

The above-mentioned main charging apparatus is accommodated in a box 25 of which the one surface is open, the box 28 is pivotally held by a support shaft 26 that is secured to a machine frame (not shown) such as of a copying machine and is urged by such a means as a pushing spring 27 or the like, so that both end portions of the Flexible sheet 2 come into contact with both end portions of the photosensitive drum 30 (see FIG. 1). Thus, both end portions of the flexible sheet 2 are press-contacted to both end portions of the photosensitive drum 30, and the flexible roller 1 is driven without any difference in the peripheral speed from the photosensitive drum According to the present invention, furthermore, it is desired to fit a rubber ring 11 on the inside of the flange ring 6 in the axial direction, so that the end portions of the flexible sheet 2 are effectively press-contacted to the end portions of the photosensitive drum 30, enabling the flexible roller 1 to be reliably driven by the photosensitive drum In this case, in particular, the rubber ring 11 is indented by the pushing Force of the pushing spring 27, and a portion 28 of the flexible sheet 2 thereon comes into surface contact with the surface of the photosensitive drum 30 maintaining a predetermined width. Therefore, a predetermined nip width is maintained between the two, and the photosensitive drum 30 can be effectively contact-charged.

So long as the surface contact between the portion 28 of the flexible sheet 2 and the drum 30 is accomplished by the pushing Force of the pushing spring 27, the rubber ring 11 may be replaced by any other elastic member such as a sponge obtained by foaming, for example, an urethane resin, or a ring-like felt.

To place the flexible sheet 2 in position, furthermore, it is desired to provide a coil spring 13 between the end portion of the brush 5 and the inner end of the flange ring 6 in the axial direction to impart some tension to the flexible sheet 2 in the axial direction.

According to the present invention as described above, the endless, flexible and electrically conducting sheet 2 in the flexible, hollow and electrically conducting roller 1 is driven at a speed in synchronism with the rotational speed of the photosensitive drum 30, the flexible sheet 2 is brought into contact with the whole surface of the photosensitive drum 30 in the axial direction maintaining a predetermined nip width while rotating the brush 5, and under this state, a predetermined charging voltage is applied to the brush roller 3 to electrically charge the photosensitive drum 30. In this case, it is desired that the brush roller 3 is rotated in the same direction as the hollow and electrically conducting roller 1 at a peripheral speed of from 0.9 to 0.95 times as great as the peripheral speed of the roller 1, i.e., of the moving speed of the photosensitive drum. With the speed of the brush roller being slightly lower than that of the hollow and electrically conducting roller 1, the brush roller 3 produces a braking action relative to the roller 1 to further effectively prevent the roller 1 from being twisted.

In the above-mentioned main charging apparatus, the flexible, endless and electrically conducting sheet 2 can be made of any material provided it is electrically conducting and is flexible. For instance, the electrically conducting sheet 2 can be made of an electrically conducting resin or rubber, a metal such as a foil, or a laminated material of a metal and a resin or a rubber.

As the electrically conducting resin or rubber, there can be used resins or rubbers blended with a variety of electric conduction-imparting agents. Preferred examples of such resins include a variety of thermoplastic elastomers such as polyester elastomer, polyamide elastomer, urethane elastomer, soft vinyl chloride resin.e styrene-butadiene-styrene block copolymer elastomer, and acrylic elastomer, as well as polyamides, copolyamides or modified products such as nylon 6, nylon 6,6 , nylon 6-nylon 6,6 copolymer, nylon 6,6-nylon 6,10 copolymer and alkoxymethylated nylon such as methoxymethylated nylon. The resins that can be used are not limited thereto only as a matter of course, but may include silicone resin, acetal resins such as polyvinyl butyral, as well as polyvinyl acetate, ethylene-vinyl acetate copolymer and ionomer. The rubbers may be natural rubber, butadiene rubber, styrene rubber, butadiene-styrene rubber, nitrile-butadiene rubber, ethylene-propylene copolymer rubber, ethylene-propylene non-conjugated diene copolymer rubber, chloroprene rubber, butyl rubber, silicone rubber, urethane rubber and acrylic rubber.

Examples of the electric conduction-imparting agent to be blended into the resins or the rubbers include electrically conducting carbon black, metal powders such as of silver, gold, copper, brass, nickel, aluminum and stainless steel, and powdery electric conduction-imparting agent such as tin oxide electric conduction-imparting agent. There can be further used nonionic, anionic, cationic and amphoteric organic electric conduction-imparting agent, and an organotin electric conduction-imparting agent.

It is desired that the electrically conducting resin or rubber usually has an electric resistance (resistivity) of from 10 to $10^8$ Ω·cm and, particularly, from $10^2$ to $10^6$ Ω·cm. Though it may vary depending upon the kind thereof, the electric conduction-imparting agent is blended in an amount of from 1 to 20 parts by weight and, particularly, from 5 to 15 parts by weight per 100 parts by weight of the resin or the rubber, such that the above-mentioned resistance is obtained. In general, a high electric conduction is obtained when the electric conduction-imparting agent grains form a chain structure in the resin or the rubber. In this case, however, high-potential dots may generate when a voltage is applied giving rise to the occurrence of irregular charging. Therefore, the electric conduction-imparting agent should be uniformly and finely dispersed in the resin or the rubber. For this purpose, it is important to sufficiently knead the resin or the rubber blended with the electric conduction-imparting agent. To uniformly and effectively disperse the electric conduction-imparting agent, furthermore, it is recommended to partly use an acid-modified resin or rubber copolymerized with an ethylenically unsaturated carboxylic acid such as acrylic acid, methacrylic acid or maleic arthydride.

The above-mentioned flexible and electrically conducting sheet 2 should have a thickness of usually from 50 to 400 μm and, particularly, from 100 to 300 μm though it may vary depending upon the flexibility required. It is further desired that the surface is as smooth as possible, and has an average coarseness of 5 μm or smaller and, particularly, 1 μm or smaller in compliance with JIS B 0601.

According to the present invention, furthermore, a seamless metal foil can be used as the flexible and electrically conducting sheet 2. As the metal foil, there can be exemplified nickel, aluminum, copper, brass and tin which can be obtained by the electrocasting method or the extrusion method. The metal foil should have a thickness of from 20 to 80 μm and, particularly, from 30 to 50 μm.

The flexible and electrically conducting sheet 2 may be made of a material of a single layer or a material of laminated layers. When the surface of the electrically conducting sheet 2 that comes into contact with the surface of the photosensitive material is formed by a layer having a high resistance, there is obtained an advantage in that leakage such as electric discharge is prevented even when there exist such defects as pinholes and the like in the surface of the photosensitive material. The high-resistance layer should have a resistivity of from $10^8$ to $10^{13}$ Ω·cm and, particularly, from $10^9$ to $10^{12}$ Ω·cm, and should have a thickness of from 40 to 60 μm. The electric resistance can be easily adjusted by adjusting the amount of the electric conduction-imparting agent that is mixed into the resin or the rubber. As the electric conduction-imparting agent and the rubber, there can be further used a fluorine-containing resin or rubber, such as vinylidene polyfluoride (PVDF), polytetrafluoroethylene (PTFE), tetrafluoroethylene-hexafluoropropylene copolymer (PTFE·HFP) and perfluoroalkoxy fluorine-containing resin in addition to the above-mentioned examples. When these resins or rubbers are used as the high-resistance layer, a great advantage is obtained with respect to life of the photosensitive material and life of the sheet since they are inert and have small coefficients of friction.

According to the present invention, the brush 5 that is favorably used is obtained by studding an electrically conducting brush made of an electrically conducting organic or inorganic fiber onto the electrically conducting roller. The brush should have a volume resistivity of From $10^2$ to $10^8$ Ω·cm and, particularly, from $10^3$ to $10^6$ Ω·cm. The brush fiber should have a thickness of from 2 to 10 denier (d) and, particularly, from 3 to 6 d, should have a fiber length (length of hair) of from 2 to 7 mm and, particularly, from 3 to 5 mm, and a hair density of from 10,000 to 200,000 hairs/sq. in. and, particularly, from 30,000 to 100,000 hairs/sq. in. from the standpoint of imparting smooth and uniform pushing force. Furthermore, the tips of The brush should be rounded to suppress the wear of the flexible sheet 2.

As The organic electrically conducting fiber, there can be used a synthetic or a regenerated fiber in which the electric conduction-imparting agent grains are dispersed, such as polyamide fiber, e.g., nylon 6, nylon 6,6, polyester fiber, e.g., polyethylene terephthalate, acrylic fiber, polyvinyl alcohol fiber, polyvinyl chloride fiber, rayon, acetate, etc. The electric conduction can be imparted to the fiber not only by the method of blending the electric conduction-imparting agent but also by a method of metallizing the surfaces of the fiber. When the electric conduction-imparting agent is to be used, the above-exemplified compounds can be used. As The electrically conducting inorganic fiber, there can be preferably used a carbon fiber as well as a metal fiber such as of a stainless steel or brass.

According to the present invention, a DC power source 20 is connected to the brush roller 3, and the flexible and electrically conducting sheet 2 is brought into contact with the surface of the photosensitive drum 30 that is rotating being pushed by the brush 5, and a DC voltage is applied to the electrically conducting sheet 2 via the brush 5 to electrically charge the surface of the photoconducting drum 30.

Figure 3:
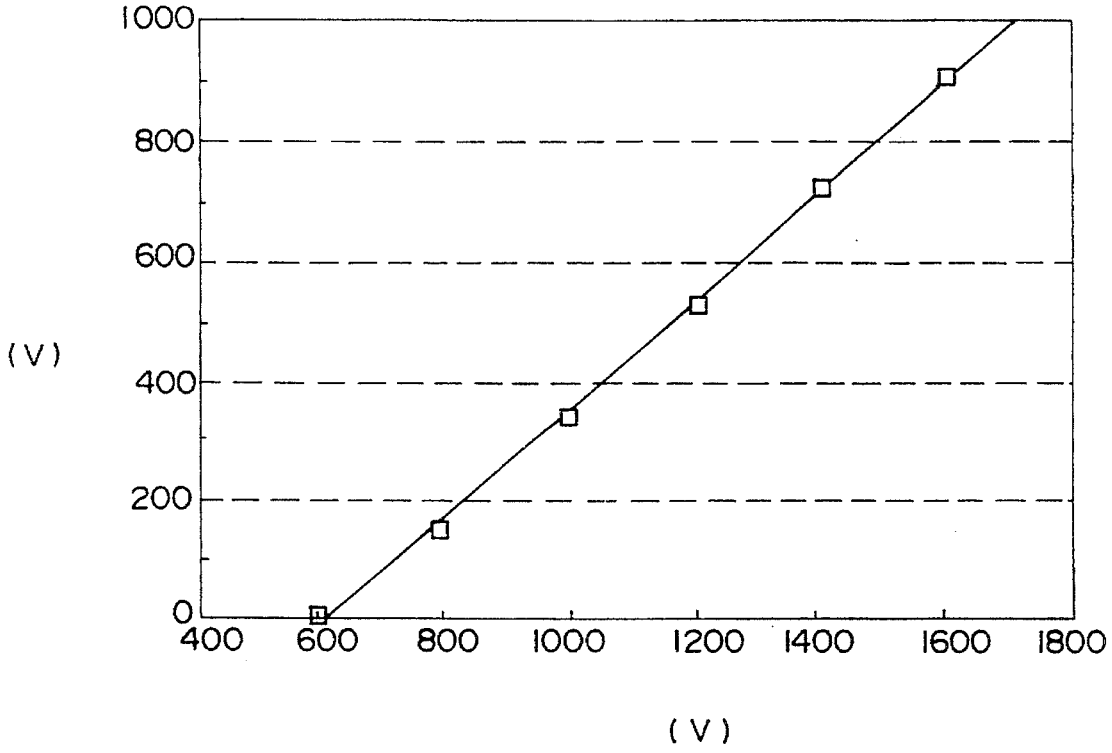
FIG. 3 is a diagram illustrating a relationship between the applied voltage and the surface potential of a photosensitive material of when an organic photosensitive material is electrically charged by the charging apparatus of FIG. 1.

It is desired that the charging voltage applied to the electrically conducting sheet 2 is set to be from 1.5 to 3.5 times as great and, particularly, from 2 to 3 times as great as the charge starting voltage on the surface of the photosensitive drum 30. FIG. 3 is a diagram illustrating a relationship between the voltage applied to the electrically conducting sheet 2 and the surface potential of the photosensitive drum 30 of when the charging method of the present invention is adapted to the organic photosensitive material. It will be understood from this diagram that a good linear relation is maintained between the applied voltage and the surface potential in the effective charging region. It will therefore be understood that in the charging method of the present invention, the potential on the surface of the photosensitive material is maintained constant at an optimum value by disposing a surface potential sensor in the periphery of the photosensitive material, and by increasing or decreasing the applied voltage based upon the surface potential detected by the sensor.

According to the present invention, uniform charging without irregularity is accomplished by using a DC voltage only. To effect the charging more uniformly, furthermore, an AC power source 21 may be used in combination with the DC power source 20 to apply a voltage which is obtained by superposing an AC voltage on the above-mentioned DC voltage. A preferred example of the alternating current has a frequency of from 300 to 1500 Hz and, particularly, from 400 to 1000 Hz, and an interpeak voltage of from 2.5 to 4 times as great and, particularly, from 2.8 to 3.5 times as great as the above DC voltage.

The above-mentioned charging apparatus is very useful for electrically charging the photosensitive materials used for the electrophotographic apparatus such as copying machine, facsimile, laser printer, etc. A variety of organic photosensitive materials can be favorably charged irrespective of whether they have a single-layer structure or a laminated-layer structure. The charging apparatus can be further suitably used for contact-charging inorganic photosensitive materials such as a-Si photosensitive material, selenium photosensitive material, and the like.

(Electrophotographic Apparatus)

Figure 4:
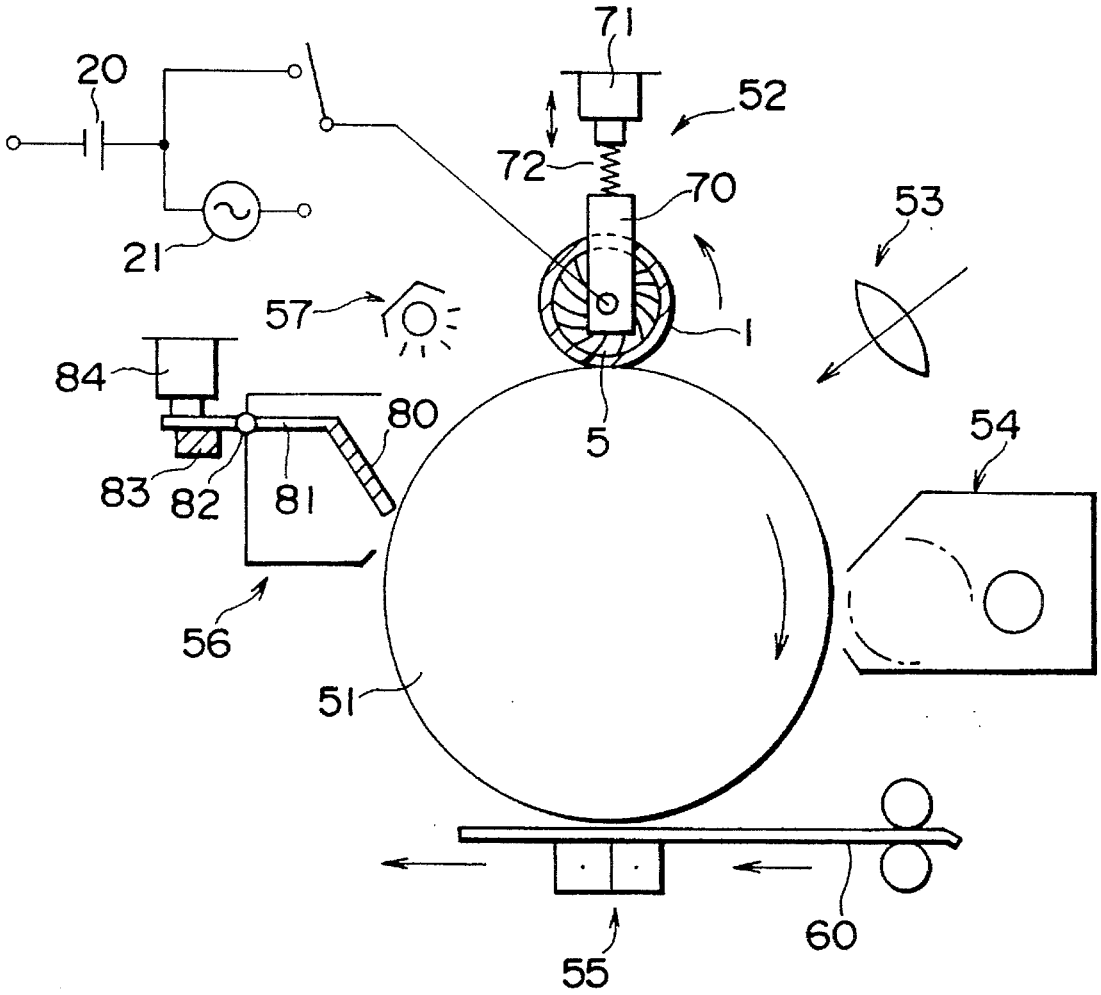
FIG. 4 is a diagram which schematically illustrates the whole structure of an electrophotographic apparatus of the present invention employing the charging apparatus of FIG. 1.

FIG. 4 illustrates the entire structure of an electrophotographic apparatus of the present invention employing the above-mentioned main charging apparatus.

The electrophotographic apparatus comprises a photosensitive drum 51 that is rotatably provided, a main charging apparatus 52 arranged in the periphery of the photosensitive drum 51 along the direction of rotation thereof, an image-exposing mechanism 53, a developing mechanism 54, a transfer mechanism 55, a cleaning mechanism 56 and a discharging mechanism 57 by exposure to light.

That is, the surface of the photosensitive drum 51 is electrically charged by the main charging apparatus 52, and is exposed to the light which is bearing document image by the exposing mechanism 3, and an electrostatic latent image corresponding to the document image is formed on the surface of the photosensitive drum 51. Then, the latent image is developed by the developing mechanism 54 and a toner image is formed on the surface of the photosensitive drum 51. The toner image is transferred by the transfer mechanism 55 onto a predetermined paper 60 which is then carried to a known fixing mechanism which is not diagramed where the toner image is fixed by the application of heat, pressure and the like. The photosensitive drum 51 from which the image is transferred is brought to the cleaning mechanism 56 where the toner remaining on the surface is removed, and is then brought to the discharging mechanism 57 where the electric charge is discharged by being exposed to light. A cycle for forming image is thus completed.

The main charging apparatus 52 used for the electrophotographic apparatus of the present invention having the above-mentioned construction is the one of the contact-charging type shown in FIGS. 1 and 2. In this photographic apparatus, the main charging apparatus 52 is held being brought into contact with the surface of the photosensitive drum 51 during the step of forming image, and is held being separated away from the surface of the photosensitive drum 51 when the step for forming image is finished. The main charging apparatus 82 is provided with a suitable frame 70 to adjust its position, and the frame 70 is supported by a spring 72 coupled to a solenoid 71 that is secured to a machine frame (not shown). By energizing the solenoid 71, the up-and-down motion of the main charging apparatus 52 is controlled through the spring 72, and the hollow and electrically conducting roller 1 comes into press-contact with the surface of the photosensitive drum 51 or is separated away from the surface of the photosensitive drum 51 when the resilient force is removed.

According to the present invention, the up-and-down motion of the main charging apparatus 52 is controlled in relation to the cleaning mechanism 56.

The cleaning mechanism 56 is constituted by a cleaning blade 80. Here, for instance, a support plate 81 of the blade 80 is held to turn with a fulcrum 82 as a center, and the blade 80 is urged by a weight 83 provided at the end thereof to come into contact with the surface of the photosensitive drum 51. A solenoid 84 is provided close to the end of the support plate 81, and the blade 80 is separated away from the surface of the photosensitive drum 1 by the operation of the solenoid 84.

Figures 5A, 5B, 5C, 5D:
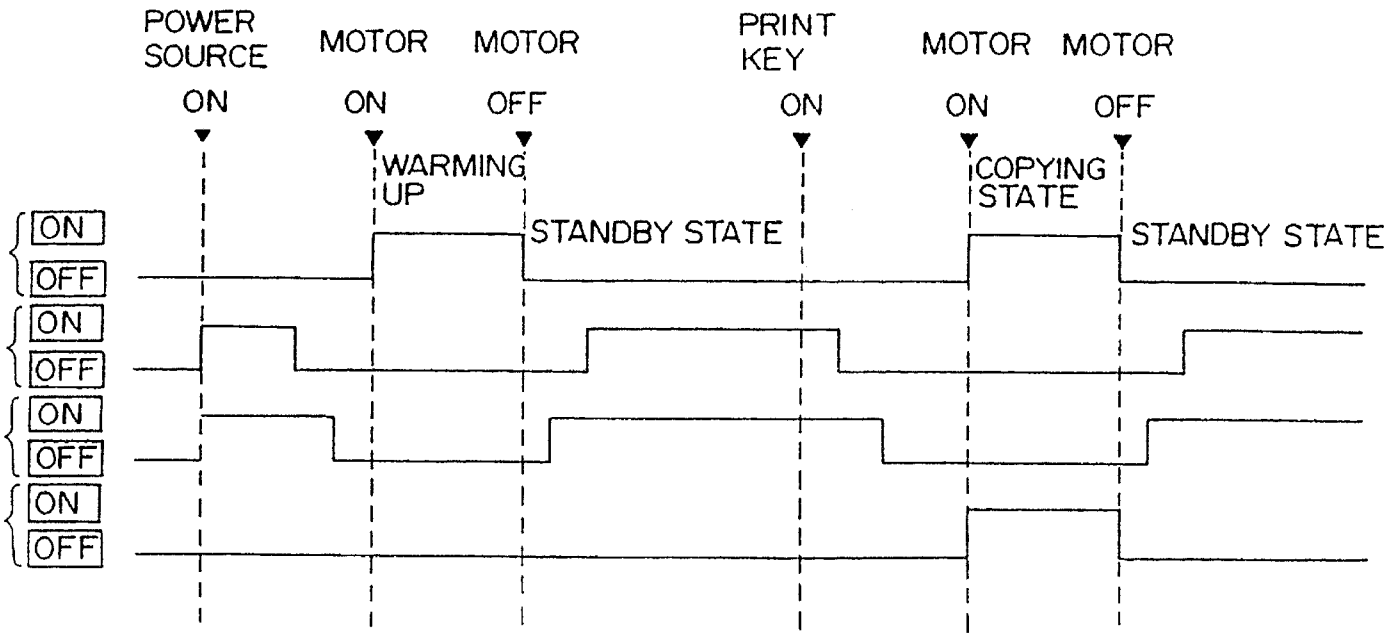
FIGS. 5A, 5B, 5C and 5D are flow charts illustrating the timings for driving the electrically conducting roller (charging roller) and the cleaning member in the electrophotographic apparatus of FIG. 4.

That is, to start the image formation according to the present invention, operation timings of the solenoids 71 and 84 are controlled so that the cleaning blade 80 first comes into contact with the surface of The photosensitive drum 1 and that the hollow and electrically conducting roller 1 comes into press-contact with the surface of the photosensitive drum 51 being slightly lagged behind. To end the step of image formation, the hollow and electrically conducting roller 1 is separated away from the surface of the photosensitive drum 51 and then the cleaning blade 80 is separated away from the surface of the photosensitive drum S1 being slightly lagged behind. Such timings can be easily adjusted by using suitable relay circuits for energizing the solenoids 71 and 84. These timings are shown, for example, in the flow charts of FIGS. 5A, 5B, 5C and 5D. FIG. 5A illustrates an on/off cycle for rotation of the photosensitive material 51. FIG. 5B illustrates an on/off cycle for the cleaning solenoid 84. FIG. 5C illustrates an on/off cycle for the charging roller solenoid 71. FIG. 5D illustrates an on/off cycle for the application of voltage to the charging roller 1. The members are operated being controlled by a computer in compliance with this chart.

In the above-mentioned electrophotographic apparatus, the contact-charging by the main charging apparatus 52 is carried out under the same conditions as those of the charging apparatus of FIGS. 1 and 2.

As the image-exposing mechanism 53, there can be employed any known mechanism in which the surface of the photosensitive drum 51 is irradiated with the reflected light of document through an optical system. As the developing mechanism 54, furthermore, any known developing mechanism can be used without limitation, such as a magnetic brush developing method using a magnetic developing agent of one-component type or two-component type or a method which effects the developing by carrying the electrically charged toner to the zone of developing the surface of the photosensitive drum 51 by utilizing the electrically attracting force, under the known developing conditions.

As the transfer mechanism 55, there can be used a known corona charger such as a transfer charger and as the discharging mechanism 57 by exposure to light, any mechanism can be used which permits the whole surface of the photosensitive drum 51 to be irradiated with light from a suitable source of light.

By using the above-mentioned electrophotographic apparatus, the flexible, hollow and electrically conducting roller 1 of the main charging apparatus 52 is maintained out of contact with the photosensitive drum after the completion of the step of forming image making it possible to effectively prevent the hairs of the brush roller contained therein from falling down and to prevent the hollow and electrically conducting roller 1 from being deformed thereby, and enabling the electric charging to be carried out uniformly and stably for extended periods of time.

Furthermore, the hollow and electrically conducting roller 1 is brought into contact with the surface of the photosensitive drum 51 immediately after it is cleaned, effectively preventing toners and the like left on the surface of the photosensitive material from migrating onto the roller, enabling the contact-charging to be stably carried out by the roller, and effectively preventing the photosensitive drum 51 from being contaminated again by the toner adhered to the roller.

We claim:

1. In an electrophotographic apparatus comprising a movable, electrically chargeable, photosensitive material and, in the following order, a main electrical charging apparatus, an image-exposing mechanism, a developing mechanism, a transfer mechanism and a cleaning member, said order being along a direction of movement of said photosensitive material, wherein said main electrical charging apparatus comprises a rotatable, flexible, hollow, electrically conducting roller and a rotatable, electrically conducting brush roller disposed within said hollow roller and concentric therewith, said hollow roller and said brush roller being rotatable relative to each other, said hollow roller being contactable with said photosensitive material, the improvement comprising:

said brush roller including a shaft supporting said brush roller for rotational movement, said hollow roller comprising an endless, flexible, electrically conducting sheet having a first end portion and a second end portion, each of said first and second end portions fixed on a respective roller flange, each of said roller flanges being disposed on said shaft supporting said brush roller for independent rotation thereabout;

an elastic member is provided on each said roller flanges between a respective end portion of said endless, flexible, electrically conducting sheet and its respective roller flange so as to be covered by a respective portion of said endless, flexible, electrically conducting sheet, each said elastic member elastically forcing said respective covering portion of said endless, flexible, electrically conductive sheet against said photosensitive material when said photosensitive material is contacted by said hollow roller wherein movement of said photosensitive material causes rotation of said hollow roller.

2. An electrophotographic apparatus according to claim 1, wherein said elastic member is a rubber ring fitted into each of said roller flanges.

3. An electrophotographic apparatus according to claim 1, wherein said hollow roller is movable between a first position wherein it is in contact with said photosensitive material and a second position wherein it is out of contact with said photosensitive material; said cleaning member is movable between a first position wherein it is in contact with said photosensitive material and a second position wherein it is out of contact with said photosensitive material; said hollow roller and said cleaning member cooperating so that, when said hollow roller is moved from said second position to said first position, said cleaning member is moved from said second position to said first position prior to movement of said hollow roller from said second position to said first position and, when said hollow roller is moved from said first position to said second position, said cleaning member is moved from said first position to said second position after movement of said hollow roller from said first position to said second position.

4. An electrophotographic apparatus according to claim 3, wherein said hollow roller and said cleaning member are moved between their respective first and second positions by solenoids.

* * * * *